US005695120A

United States Patent [19]

Kingsford

[11] Patent Number: 5,695,120

[45] Date of Patent: Dec. 9, 1997

[54] SPRAY GUN

[75] Inventor: Kenji A. Kingsford, Devore, Calif.

[73] Assignee: Furon Company, Laguna Niguel, Calif.

[21] Appl. No.: 509,705

[22] Filed: Jul. 31, 1995

[51] Int. Cl.[6] ..... B05B 15/02

[52] U.S. Cl. ..... 239/112; 239/125; 239/525; 251/335.2; 137/625.26

[58] Field of Search ..... 239/112, 124, 239/125, 525, 526, 527; 251/335.2, 323; 137/625.26, 625.27

[56] References Cited

U.S. PATENT DOCUMENTS

| | | | |
|---|---|---|---|
| 555,738 | 3/1896 | Rushton | 239/525 |
| 2,369,356 | 2/1945 | Koehn | 251/115 |
| 2,657,098 | 10/1953 | Strahman | 299/131 |
| 2,883,117 | 4/1959 | Nelson | 239/459 |
| 2,936,959 | 5/1960 | Nord et al. | 239/525 |
| 2,942,791 | 6/1960 | Bush et al. | 239/434 |
| 3,504,855 | 4/1970 | Volker | 239/112 |
| 3,587,970 | 6/1971 | Tindall | 239/126 |
| 3,589,610 | 6/1971 | Wahlin | 239/125 |
| 3,727,481 | 4/1973 | Nicholson | 74/491 |
| 5,118,080 | 6/1992 | Harmann | 251/229 |
| 5,370,315 | 12/1994 | Del Gaone | 239/527 |
| 5,553,788 | 9/1996 | Del Gaone et al. | 239/124 |

FOREIGN PATENT DOCUMENTS

| | | |
|---|---|---|
| 1004217 | 3/1952 | European Pat. Off. . |

*Primary Examiner*—Andres Kashnikow
*Assistant Examiner*—Lisa Ann Douglas
*Attorney, Agent, or Firm*—Christie, Parker & Hale, LLP

[57] ABSTRACT

A spray gun includes a body with a barrel portion having an inner chamber that extends therethrough from a front to a rear portion, and a grip portion. The grip portion includes a water inlet conduit and water outlet conduit disposed therein that each extend through the grip portion to the internal chamber. A spray nozzle is disposed within the front portion of the barrel and includes a valve seat disposed around an inlet end of a passageway extending therethrough. A popper assembly is slidably disposed within the inner chamber and has a cylindrical body with a valve element at one end that is adapted to form a liquid-tight seal with the valve seat when the gun is operated in a no flow position. The poppet assembly also includes a diaphragm at an opposite end of the body that is adapted to form a liquid-tight seal with an adjacent portion of the inner chamber. The water inlet conduit is positioned within the inner chamber adjacent the diaphragm to dispense water adjacent the valve element, and the water outlet conduit is positioned adjacent the diaphragm to receive water circulated through the inner chamber. The spray gun includes a spring retaining body attached to the rear portion of the barrel that is adapted for accommodating pivoting attachment of a handle thereto, and for accommodating a spring to maintain engagement between the valve element and the valve seat in a no flow position. The spring retaining body and handle are each configured to provide dual-action pivoting movement of the handle.

34 Claims, 6 Drawing Sheets

10
18
28
30
14
36
126
38
22
68
12
26
80
64
26
92
46
42
58
60
48
52
62
102
24
20
100
16
124
120
122
123
122

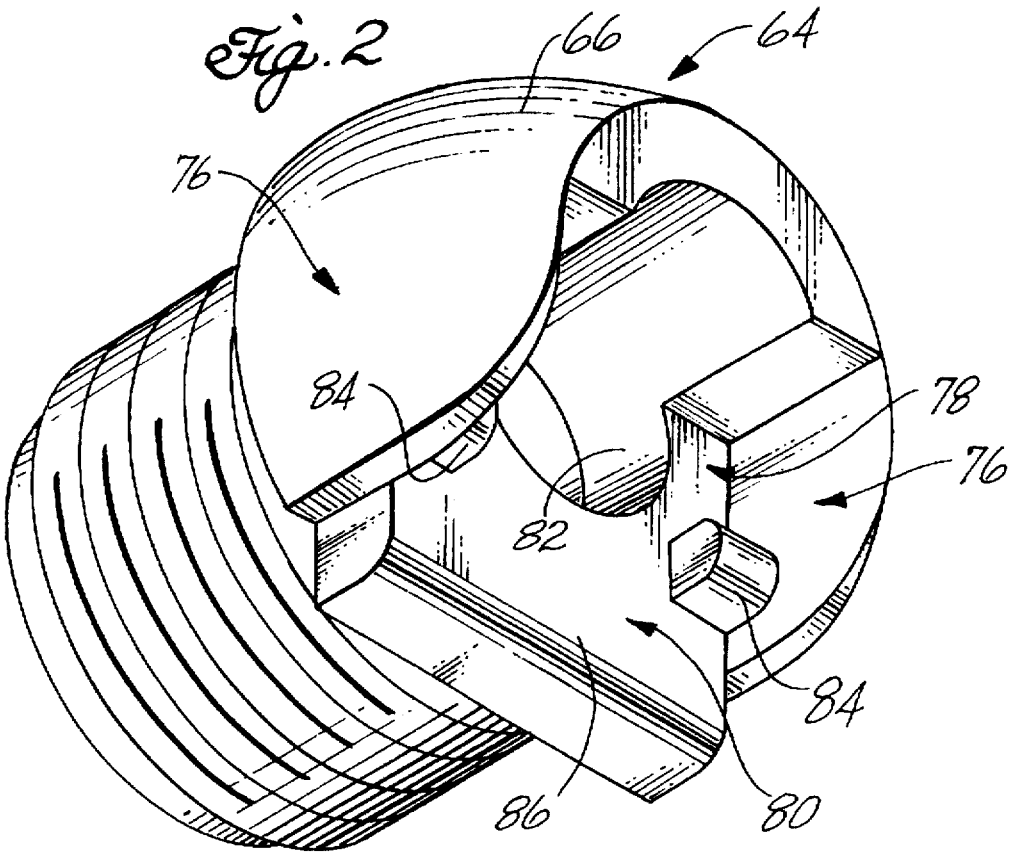
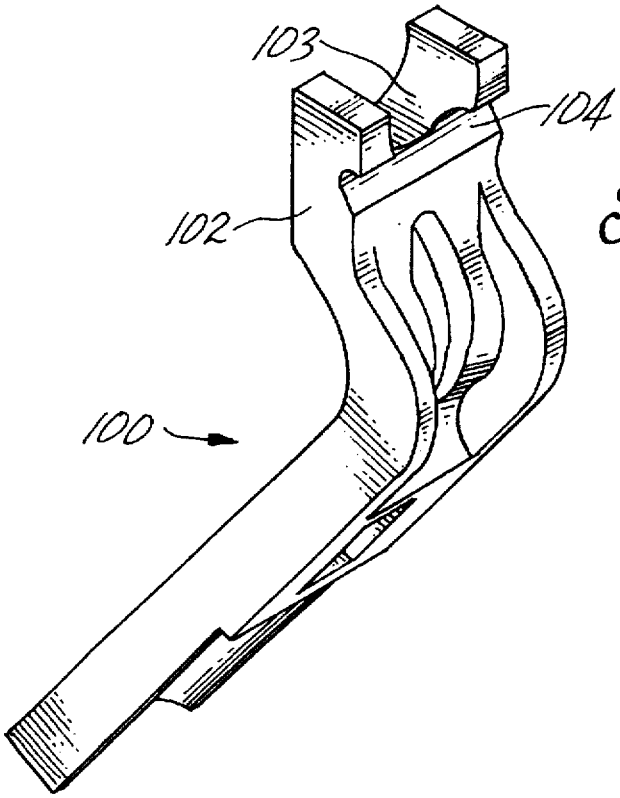
Fig. 3

SPRAY GUN

FIELD OF THE INVENTION

The present invention relates generally to a hand-held spray gun for the dispensing of liquid and, more particularly, to a hand-held spray gun for the dispensing of deionized water that is configured having a zero hold-up volume to eliminate possible biological growth.

BACKGROUND OF THE INVENTION

Hand-held spray guns are used in many different applications, both industrial and nonindustrial, to dispense a liquid onto a particular object. For example, in the manufacturing of devices that are treated with chemicals during their fabrication, e.g., semiconductor chips, hand-held spray guns are used to direct a spray of deionized water onto the chips to remove the chemical agents. In such an application it is desired that the water dispensed from the spray gun be free of any debris or material that may contaminate the semiconductor chip. Therefore, the deionized water used in such applications may additionally be filtered or treated to remove any such debris before being routed through and dispensed by the spray gun.

Prior art spray guns that are used in such applications typically include a single water inlet and a flow valve that controls both the passage of the inlet water through the valve and the dispensing of the water therefrom. A disadvantage of such conventional spray guns is that when the valve is in the no flow position, the water routed to the spray gun is retained or allowed to stagnate in an inner chamber of the gun. The presence of retained or stagnated water in the spray gun is not desired due to the possible formation and build up of biological growth which, when the valve is placed in a flow position, can be dispensed onto and thereby contaminate the object being sprayed.

Prior art spray guns are constructed having a by-pass feature that returns liquid, e.g., water, that is routed to the gun to the liquid providing source the when a flow valve within the gun is placed in a no flow position. The purpose of the by-pass feature is to prevent water being routed to the gun from stagnating within the gun when not in use. Retained or stagnant water within the gun is not desired because of possible biological growth and resulting product contamination. However, the by-pass features of such prior art guns are not completely effective at eliminating the presence of retained or stagnant water in the internal chamber of the gun because the by-pass feature does not sweep the entire wetted internal chamber. Therefore, the prior art guns are not effective in eliminating the buildup of biological growth and preventing possible contamination of the sprayed object.

In applications where spray guns are used to dispense deionized or high-purity water onto objects that are capable of being easily contaminated, it is also desired that the flow rate of water being dispensed through the gun be easily regulated by hand operation. Hand regulation of water dispensed through the spray gun is desired to allow the operator to vary the water delivery flow rate to account for different types of objects, e.g., for delicate or fragile objects.

Prior art spray guns include a handle flow control mechanism that regulates the amount of water dispensed from the gun according to the amount that the handle is depressed. The flow control mechanism in such spray guns is configured to dispense an amount of water that is proportional to the degree that the handle is depressed. For example, as the handle is continuously depressed an increasing amount from a no flow position, the amount of water dispensed from the gun also increases continuously from no flow to some maximum flow rate. Proportional flow control mechanisms do not permit fine control of the water discharge rate from the gun flow rate but, rather allow the user to crudely regulate the water discharge rate somewhere between no flow and maximum flow.

Prior art spray guns, such as that disclosed in U.S. Pat. No. 5,118,080, disclose a valve pistol housing and hand lever that are configured to provide a reduced amount of handle pressure to achieve an increasing amount of water dispensement. An arrangement of pivot pins and rollers in the pistol housing interacts with an actuating arm of the hand lever to produce a small amount of hand force to initially depress the hand lever, to initiate water dispensement from the gun, and a decreasing amount of hand force to increase the amount of water dispensement. However, this configuration still provides a generally proportional amount of water dispensement relative to the amount of handle movement, which does not facilitate fine control of water dispensement at low water flow rates.

U.S. Pat. No. 555,738 discloses an operating mechanism for throttle valves that requires a large initial lever pressure to initiate opening movement of the throttle valve, and requires a decreasing lever pressure to continue opening movement of the valve. The operating mechanism is designed to permit an operator to quickly move the valve after overcoming an initial opening pressure. This mechanism, however, still provides a generally proportional amount of valve movement relative to lever movement and does not facilitate fine control of the throttle at slightly open conditions.

U.S. Pat. No. 3,727,481 discloses variable control lever that, through cooperation of a lever arm and camming pins, provides a dual-ratio actuating member movement. The control lever is designed so that an initial movement of the lever arm produces a relatively small amount of actuating member movement, and continuing movement of the lever arm causes engagement of the arm with camming pins that cause relatively greater movement of the actuating member when compared to initial arm movement. The control lever is designed to permit gradual or slight opening of a hydraulic valve relative to lever arm movement. The lever arm mechanism, however, is neither designed nor adaptable for use with a hand-held spray gun to provide fine control of water dispensement at low water flow rates.

It is, therefore, desirable that a hand-held spray gun be constructed in a manner that eliminates the possibility of water retention and resulting bacterial growth and buildup. It is desired that the spray gun be constructed in a manner that permits fine control of water discharge at low water flow rates, while also allowing full water discharge at medium and high water flow rates. It is also desirable that the spray gun be easy to use and be manufactured using conventional methods from well known materials.

SUMMARY OF THE INVENTION

There is, therefore, provided in practice of this invention a spray gun for dispensing a liquid such as deionized water, high-purity water and the like. The spray gun includes a body, having a barrel portion with an inner chamber that extends therethrough from a front to a rear portion, and a grip portion. The grip portion includes a water inlet conduit and water outlet conduit disposed therein. The water inlet and water outlet conduit each extend through the grip portion to the internal chamber. A spray nozzle is disposed within the front portion of the barrel and includes a valve seat disposed around an inlet end of a passageway that extends therethrough.

A poppet assembly is slidably disposed axially within the inner chamber. The poppet assembly has a cylindrical shaft-like body and includes a valve element at one end of the body that is adapted to form a liquid-tight seal with the valve seat when the spray gun is operated in a no flow position. The poppet assembly also includes a diaphragm at an opposite end of the body that is adapted to form a liquid-tight seal with an adjacent portion of the inner chamber.

The water inlet conduit and the water outlet conduit each extend through the grip portion of the body to a bottom portion of inner chamber. The water inlet conduit is positioned within the inner chamber adjacent the valve element and valve seat, and the water outlet conduit is positioned within the inner chamber adjacent the diaphragm to receive water circulated through inner chamber from the water inlet conduit. The arrangement of the water inlet and water outlet conduits within the inner chamber, and the formation of a liquid-tight seal between the tongue an groove, permits water entering the inner chamber to be constantly recirculated through the inner chamber when the gun is operated in a no flow position, prohibits water from entering parts of the inner chamber where it could be retained, and thereby eliminates the formation of bacterial formation and build up.

The spray gun includes means for maintaining seated engagement between the valve element and valve seat when the valve is operated in a no-flow condition, and means for unseating the valve element and valve seat by hand activation. The means includes a spring retaining body attached to a rear portion of the barrel that is adapted to accommodate pivotal attachment of a handle therein. The spring retaining body and handle are each configured to provide two-stage poppet assembly displacement within the inner chamber.

The poppet assembly is attached to the handle via a poppet actuator and a poppet connection element, wherein in an initial pivoting action of the handle the poppet assembly is axially displaced within the inner chamber by a relatively small amount compared to the movement of the handle. A desired handle displacement to poppet assembly displacement ratio is greater than about 2:1. In a secondary pivoting action, the poppet assembly is displaced within the inner chamber by an amount greater than that of the initial pivoting action compared to the movement of the handle. A desired handle displacement to poppet assembly displacement ratio is less than about 2:1.

Configured in this manner the spray gun allows an operator to have a fine degree of control over water flow dispensement during the initial pivoting action without sacrificing the ability to have full water flow dispensement during the secondary pivoting action.

BRIEF DESCRIPTION OF THE DRAWINGS

These and other features and advantages of the present invention will become appreciated as the same becomes better understood with reference to the specification, claims and drawings wherein:

FIG. 2 is a perspective view of a spring retainer body of the spray gun of FIG. 1;

FIG. 3 is a perspective view of a handle of the spray gun of FIG. 1;

DETAILED DESCRIPTION

This invention relates to a hand-held spray gun that is used to dispense a liquid onto an object. The spray gun can be used to dispense any type of low viscosity liquid, such as organic and inorganic solvents, including water. In a preferred embodiment, the spray gun is used to dispense deionized water in applications where a fine degree of control at low water flow rates is desired. To prevent the formation and buildup of bacterial growth in the spray gun, caused by retained or stagnated water in the gun, the spray gun has been constructed having inner chamber and valve assembly that has a zero hold-up volume that is completely swept at no flow conditions by a water recirculation system. Additionally, to permit fine control of water dispensement at low water flow rate conditions, the spray gun includes a dual-action handle flow control mechanism.

Figure 1:
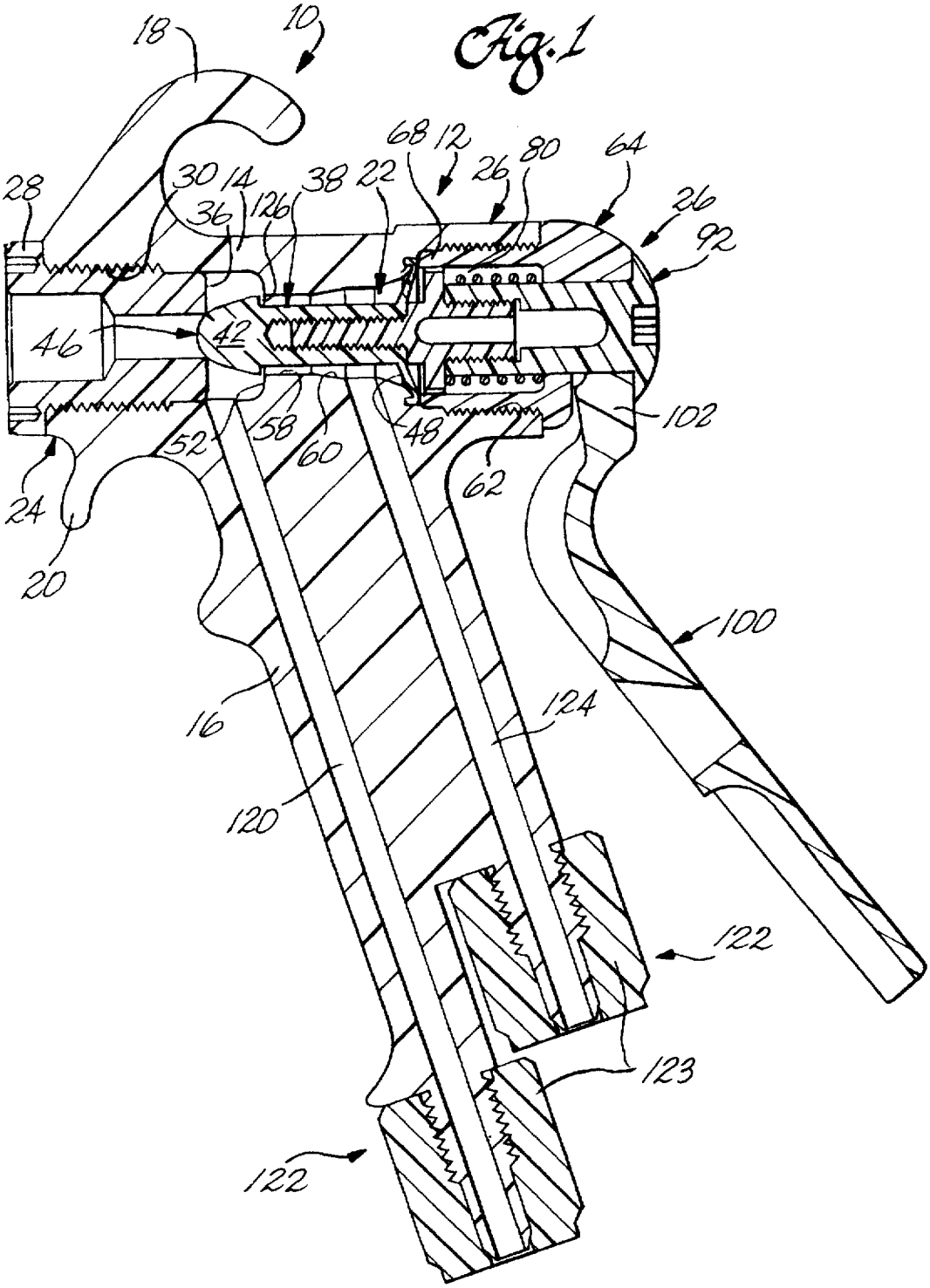
FIG. 1 is a cross-sectional side elevational view of a spray gun constructed according to principles of this invention.

Referring to FIGS. 1 and la, a spray gun 10 constructed according to principles of this invention includes a body portion 12 formed from a suitable rigid structural material. The body 12 is formed to facilitate hand-held operation and comprises a barrel portion 14 and a grip or handle portion 16. The body can include hooks 18 and 20, projecting from the top and bottom of the barrel portion 14, for hanging the spray gun on associated spray system equipment and the like when not in use. In an example embodiment of the spray gun, the barrel portion 14 has a length of approximately 6.5 centimeters (cm), and the grip portion 16 extends away from the barrel portion at an angle of approximately 73 degrees and has a length of approximately 8.5 cm. It is to be understood that the dimensions provided above and below are provided only for purposes of reference and clarity, and that the spray gun may be constructed in many different sizes to accommodate different applications.

The barrel portion 14 includes a hollow inner chamber 22 that extends axially therethrough from a front portion 24 to a rear portion 26 at opposite ends of the barrel. Moving from the front portion toward the rear portion in FIGS. 1 and 1*a*, and referring particularly to FIG 1*a*, a spray nozzle 28 is threaded into a first enlarged diameter section 30 of the inner chamber 22 adjacent the front portion 24. The spray nozzle is preferably made from a corrosion resistant material and may be configured to have a number of different spray patterns. The spray nozzle 28 has an inner passageway 32, that is coaxial with the inner chamber 22, and has a valve seat 34 around an outside circumference of the passageway 32 at an inlet end 36. In one embodiment, the first enlarged diameter section 30 has a diameter of approximately 1.6 cm, and extends axially within the inner chamber a length of approximately 2.8 cm. The spray nozzle 28 in such example embodiment has an inner passageway 32 and valve seat 34 diameter of approximately 0.6 cm.

A poppet assembly 38 is disposed axially within the inner chamber 22 upstream from the spray nozzle 28. The poppet assembly 38 comprises a long hollow cylindrical shaft-like body 40 having a valve element 42 at one end of the shaft adjacent the spray nozzle. The hollow shaft 40 is threaded along an inside surface to accommodate connection with a poppet connecting element described below. The valve element 42 is formed from an enlarged diameter section of the shaft 40 having a generally cone-shaped outer surface 44 of decreasing diameter moving toward the spray nozzle. The valve element 42 has a rounded nose portion 46 that defines one end of the poppet assembly.

The poppet assembly 38 includes a diaphragm 48 at an end of the shaft 40 opposite from the nose portion 46, which is integral with the shaft and extends radially a distance away from the shaft. The diaphragm 48 includes a tongue 50 that extends circumferentially around a peripheral edge of the diaphragm. As discussed in greater detail below, the tongue 50 fits into a groove in the inner chamber 22 to provide a liquid-tight attachment of the poppet assembly within the inner chamber. In an example embodiment, the poppet assembly 38 shaft 40 has a diameter of approximately 0.7 cm, and a length of approximately 3 cm, as measured from the end of the valve element 42 to the end of the diaphragm 48. The valve element 42 has a maximum diameter of approximately 0.9 cm, and a length of approximately 0.8 cm. The diaphragm 48 has a diameter of approximately 2 cm, and the tongue 50 extends outwardly away from the diaphragm a distance of approximately 0.2 cm.

A key feature of the poppet assembly 38 is the integral construction of the valve element 42, the shaft 40 and the diaphragm 48. The integral construction serves to reduce leak paths within the inner chamber and, thus acts to prevent water from entering otherwise nonwetted portions of the inner chamber where it could be retained, stagnate and cause bacterial formation.

The first enlarged diameter section 30 of the inner chamber 22 includes a shoulder portion 52, having a reduced diameter. The shoulder portion is located a sufficient distance from the front portion 24 of the barrel so that a space 54 exists between the valve seat 34 end of the spray nozzle 26 and the shoulder portion 52. Moving toward the rear portion 26 of the barrel, the inner chamber has an opening 56 at the shoulder portion 52, a first constant diameter section 58 that extends axially a distance toward the rear portion 26, a first flared section 60 that extends from the first constant diameter section to a second constant diameter section 61, and a second flared section 63 that extends to a second enlarged diameter section 62 at the rear portion of the barrel.

In an example embodiment, the opening 56 and first constant diameter section 58 diameter are both approximately 0.902 cm, i.e., approximately 0.002 cm larger than the diameter of the valve element to facilitate installing the poppet assembly into the inner chamber from the rear portion of the barrel body, and the first constant diameter section 58 length is approximately 0.6 cm. The first flared section 60 extends axially through the inner chamber a length of approximately 0.6 cm, and flares outwardly away from the first constant diameter section 58 at an angle of approximately 20 degrees. The second constant diameter section 61 has a diameter of approximately 1 cm, and an axial length of approximately 0.2 cm. The second flared section 63 extends axially through the inner chamber a length of approximately 0.4 cm, and flares outwardly away from the second constant diameter section 61 at an angle of approximately 30 degrees. The second enlarged diameter section 62 has a diameter of approximately 2 cm and extends axially within the inner chamber a length of approximately 1.6 cm.

The poppet assembly 38 is disposed within the inner chamber so that, when the gun is in no flow operation, the valve element 42 resides within the first enlarged diameter section 30 with the nose portion 46 placed in sealing contact against the valve seat 34 of the spray nozzle 28. The valve element 42 is sized so that it can pass through the opening 56 and into the first constant diameter section 58 of the inner chamber when the gun is in flow operation. In the no flow position, the valve element 42 is in the first enlarged diameter section 30 and the shaft 40 resides within the first constant diameter section 58, the first flared section 60, the second constant diameter section 61, and the second flared section 63 of the inner chamber.

A spring retaining body 64 is removably attached to the rear portion 26 of the barrel and includes a head 66 and a cylindrical section 68 that extends away from the head. The cylindrical section 68 is threaded along its outer surface to engage and mate with threads disposed along the inside surface of the second enlarged diameter section 62 at the rear portion 26 of the barrel. The cylindrical section 68 has a front or forward end 70 that is sized and configured to contact a backside surface of the diaphragm 48. The forward end 70 holds the tongue 50 within a groove 72 that is disposed around a shoulder portion 74 of the second enlarged diameter section 62, when the spring retaining body 64 is completely threaded therein. The spring retaining body 66 is sized and configured to abut against the rear portion 26 of the barrel when the cylindrical section 68 of the spring retaining body is completely threaded into the second enlarged diameter section 62.

In an example embodiment, the cylindrical section 68 has a diameter of approximately 2 cm and a length of approximately 1.6 cm. The groove 72 has an outside diameter of approximately 1.9 cm. As described below, the groove 72 is sized having a diameter smaller than the tongue 50 to impose a loading force on the diaphragm 48 when installed therein. The spring retaining body head 66 has an outside diameter of approximately 2.7 cm.

Referring now to FIG. 2, the spring retaining body head 66 has a collar 76 that extends around top and side portions of the head, defining walls of a cut-out portion 78 that resides therein. The cut-out portion 78 has a base 80 and an opening 82 perpendicular to the base that passes axially through the head and the cylindrical section. The base 80 includes a pair of pivot extensions 84 that each project from opposite sides of the base, and a secondary pivot surface 86 that extends a distance along a bottom portion of the base, which will be discussed in greater detail below. In an example embodiment, the pivot extensions have a semicircular profile with a radius of approximately 0.15 cm and project outwardly away from the base a distance of approximately 0.3.

Referring back to FIG. 1*a*, the retaining body cylindrical section 68 has a hollow a spring retaining chamber 88 disposed therein that extends axially from the opening 82 through the base 80 to the front end 70 of the spring retaining body. The spring retaining chamber 88 is sized larger in diameter than the opening 82 to accommodate placement of a spring therein, forming a shoulder 90 at the transition from the opening 82. In an example embodiment, the opening 82 has a diameter of approximately 1.1 cm and an axial length of approximately 0.3 cm. The spring retaining chamber 88 has a diameter of approximately 1.6 cm and an axial length of approximately 1.7 cm.

A poppet actuator 92 is disposed within the spring retaining body 64 through the opening 82 and into the spring retaining chamber 88. The poppet actuator 92 has a generally cylindrical shaft-like hollow body 94 with a flared head 96 at one end that is sized and configured to abut against an adjacent end 66a of the spring retaining body head 66. The hollow body 94 has a threaded inner surface that extends from a forward end 98 a distance toward the flared head 96. In an example embodiment, the poppet actuator hollow body 94 has an outside diameter of approximately 1 cm and a length of approximately 2.5 cm. The flared head 96 has a diameter of approximately 1.9 cm.

Figure 1A:
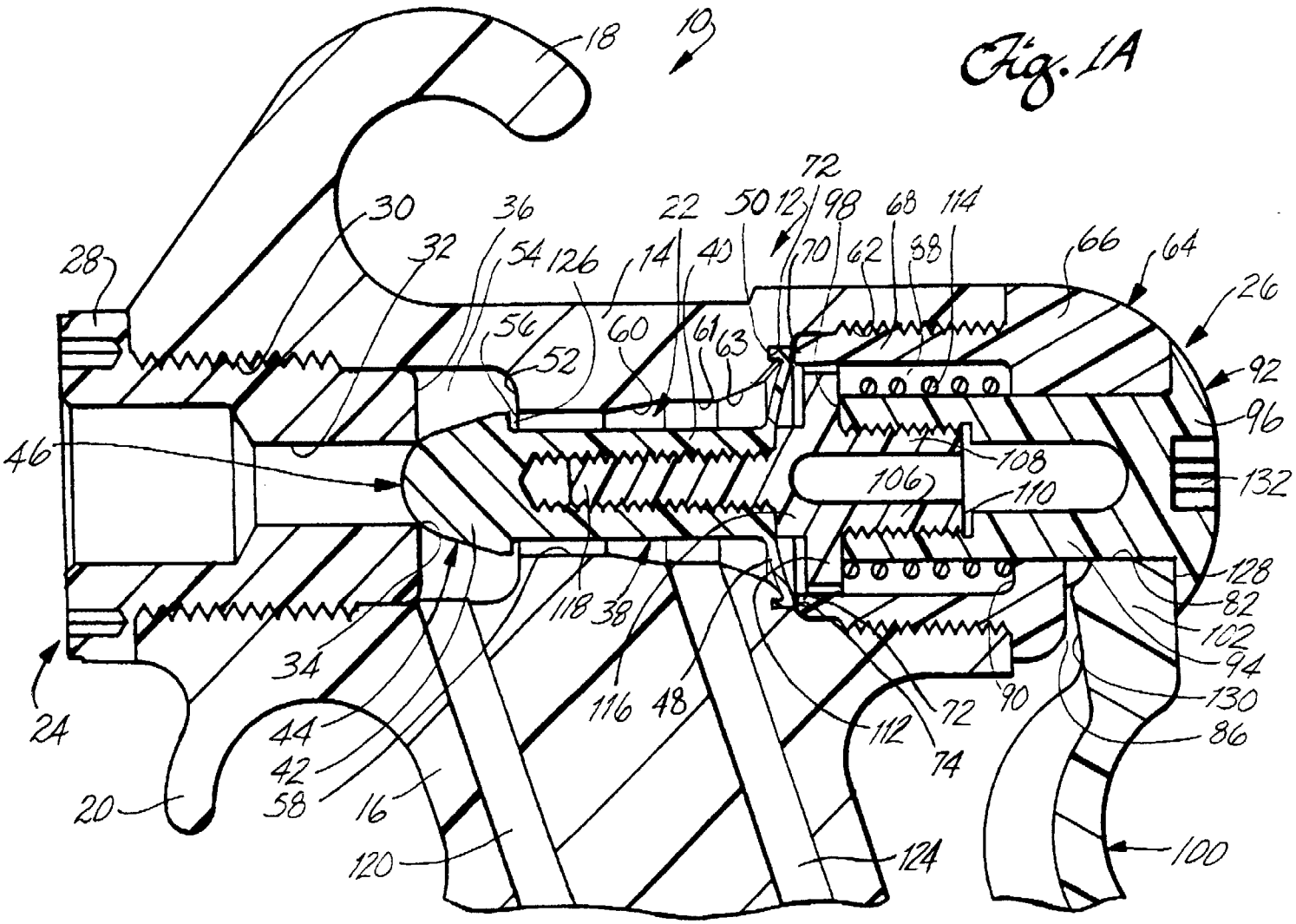
FIG. 1*a* is a cross-sectional side elevational view of a barrel portion of the spray gun of FIG. 1.

Turning to FIGS. 1 and 2 in addition to FIG. 1a, a handle 100 is pivotally mounted at an actuator end 102 at the rear portion 26 of the gun within the cut-out portion 78 of the spring retaining body head 66. As best shown in FIG. 3, the handle actuator end 102 includes a semi-circular cut out portion 103 that extends axially through the thickness of the handle to accommodate placement against the outside surface of the poppet actuator body 94. The handle actuator end 102 also includes a groove 104 disposed within a surface facing the base 80 that is configured to accommodate placement of the pivot extensions 84 therein. The groove 104 extends across the width of the actuator end 102 and is positioned tangent to a bottom portion of the cut-out portion 103. Referring back to FIG 1a, the handle 100 is held within the cut-out portion 78 of the spring retaining body head 66 by contact, along a backside surface of the actuator end 102, with an adjacent surface of the flared head 96. In an example embodiment, the cut-out portion 103 has a radius of approximately 1.1 cm, and the groove 104 has a radius of approximately 0.17 cm.

As best seen in FIG. 1a, a poppet connecting element 106, in the form of a generally cylindrical shaft, extends between and connects together the poppet actuator 92 and the poppet assembly 38. The poppet connecting element 106 has a first hollow cylindrical section 108 at one end 110 that is threaded along an outer surface to engage and mate with the threaded inner surface of the hollow poppet actuator body 94. A first flange 112 extends radially away from the first cylindrical section 108 and has an outside diameter smaller than the spring retaining chamber 88 to facilitate slidable displacement therein. The first flange 112 is positioned axially along the connecting element 106 to abut against the forward end 98 of the poppet actuator 92 when the first cylindrical section 108 is completely threaded into the actuator body 94. In an example embodiment, the first hollow cylindrical section 108 of the poppet connecting element 106 has a diameter of approximately 0.8 cm, and an axial length of approximately 0.9 cm. The first flange 112 has a diameter of approximately 1.6 cm and an axial length of approximately 0.2 cm.

A spring 114 is disposed within the spring retaining chamber 88, radially around an outside surface of the poppet actuator body 94. The spring 114 is disposed axially between the shoulder portion 90 of the spring chamber and the first flange 112 of the poppet connecting element 106. In a relaxed state, the spring 114 is longer than the distance between the shoulder portion 90 and the first flange 112. Accordingly, the spring is disposed within the spring retaining chamber in a loaded state that is created by the threaded connection of the poppet connecting element 106 with the poppet actuator 92. The spring 114 is selected so that it both provides a predetermined degree of poppet actuation resistance in response to depression movement of the handle 100, and imposes a predetermined amount of force on the poppet assembly 38 to maintain a liquid-tight seal between the valve seat 34 and the nose portion 46 of the valve element 42. In an example embodiment, the spring has a relaxed length of approximately 2.2 cm.

Proceeding from the first flange 112 forward toward the poppet assembly 38, the poppet connecting element 106 includes a second flange 116 that is smaller in diameter than first flange 112. The diameter of the second flange 116 is approximately the same as the diameter of the first cylindrical section 108 of the poppet element 106. The second flange 116 is larger in diameter than a second cylindrical section 118 of the connecting element 106 that extends axially a distance away from the second flange 116 and has threads around an outside surface configured to engage and mate with the threaded inside surface of the hollow poppet assembly shaft 40. The second flange 116 is sized and configured to contact a backside surface of the poppet assembly diaphragm 48 when the second cylindrical section 118 is completely threaded within the hollow shaft 40.

In an example embodiment, the second flange 116 of the poppet element 106 has a diameter of approximately 0.8 cm and an axial length of approximately 0.2 cm. The second cylindrical section 118 of the poppet element 106 has a diameter of approximately 0.4 cm and an axial length of approximately 1.6 cm.

Turning to FIG. 1, the grip or handle portion 16 of the spray gun body 12 includes a water inlet conduit 120 that extends therethrough from a bottom end 122 to the inner chamber 22. The water inlet conduit 120 passes through a bottom wall forming the first enlarged diameter section 30 of the inner chamber between the shoulder portion 52 and the adjacent end 36 of the spray nozzle 28. The grip portion 16 also includes a water outlet conduit 124 that extends therethrough from the bottom end 122 to the inner chamber 22. The water outlet conduit 124 passes through a bottom wall forming the first flared section 60 of the inner chamber near the second enlarged diameter section 62. If desired, a restriction orifice (not shown) can be placed within the water outlet conduit 124 to restrict the flow rate of by-pass liquid through the inner chamber. To effectively preclude biological growth from forming in the inner chamber it is only necessary that the water not stagnate and move at some minimum flow rate through the inner chamber. A restriction orifice is useful to reduce the by-pass flow rate to the minimum flow rate, thereby conserving water and minimizing associated water costs. In one example, the restriction orifice may have an orifice opening diameter of approximately 0.5 cm.

The bottom end 122 of each water inlet and outlet conduit is configured to accommodate connection with inlet and outlet water attachments, such as those of a water recirculation system and the like. In a preferred embodiment, the bottom end 122 of each water inlet and outlet conduit is configured having a threaded male connection to accommodate threaded connection with a respective nut 123 of a flared tubing inlet and outlet water attachment.

Turning to FIG. 1a, the water inlet conduit 120 serves to facilitate the transport of water into the spray gun, where it is routed directly into the inner chamber adjacent the spray nozzle inlet for dispensement therefrom. When placed in a no flow position, i.e., when the handle 100 is not depressed to cause the nose portion 46 of the valve element 42 to move away from its seated contact against the valve seat 34, the water routed into the inner chamber 22 is allowed to pass over the valve element 42, through a gap 126 between the outside surface of the valve element and the adjacent surface of the inner chamber. Water passing through the gap 126 enters the first constant diameter section 58 of the inner chamber, passes through the first flared section 60, the second constant diameter section 61, and the second flared section 63 of the inner chamber 22, moves toward the second enlarged section 62, and exits the inner chamber via the water outlet conduit 124.

Water that passes through the gap 126 is prevented from entering the spring retaining chamber 88 and wetting the threaded connection between the cylindrical section 68 and the second enlarged diameter section 62 because of the liquid-tight tongue and groove seal formed between the poppet assembly diaphragm 48 and the inner chamber. The tongue and groove seal is configured to provide a liquid-tight seal having a zero hold-up volume, i.e., that does not itself retain any volume of liquid. It is desired that water not be allowed to enter the spring retaining chamber 88 since this portion of the inner chamber is not within the wetted inner chamber portion between the water inlet conduit and water outlet conduit and, therefore, would stagnate and eventually cause unwanted formation of biological growth therein.

A key feature of the spray gun constructed according to principles of this invention is that water entering the gun via the water inlet conduit 120 is circulated through the entire wetted surface of the inner chamber, eliminating water retention and stagnation within the inner chamber and, thus eliminating the possibility of bacteria growing and building up with the inner chamber.

When the spray gun 10 is positioned in a flow position, i.e., when the handle 100 has been depressed to remove the nose portion 46 of the poppet assembly from its seated position against the valve seat 34, the valve element 42 is axially displaced into the first constant diameter section 58 of the inner chamber. In a preferred embodiment, the valve element 42 is sized having an outside diameter that will both allow axial displacement within the first constant diameter section 58 and prevent recirculation flow through the inner chamber. In such an embodiment, 100 percent of the water entering the inner chamber from the water inlet conduit 120 is passed through the spray nozzle 28 and is dispensed from the gun.

However, due to the integral construction of the poppet assembly 38 and the configuration of the inner chamber 22, necessitating loading of the poppet assembly from the rear portion 26 of the barrel, the valve element 42 is sized having a diameter that will facilitate placement through the first constant diameter section 58 during loading. In such an embodiment, when operated in a flow position, the clearance between the valve element 42 and the surface of the first constant diameter section 58 may allow for 99 percent of the water entering the spray gun to pass through the spray nozzle, and one percent of the water to recirculate through the remaining wetted portion of the inner chamber to the water outlet conduit 124. In an example embodiment, the clearance between the valve element 42 and the surface of the first constant diameter section 58 is approximately 0.002 cm.

In one embodiment, when operated in a flow position the spray gun is configured to accommodate a water throughput flow rate of up to about ten gallons per minute. And when operated in a no flow position the spray gun is configured to provide a water bypass flow rate of from about ten to twenty percent of the water throughput flow rate.

The spray gun of this invention is constructed so that the poppet assembly 38 is in a no flow position, or normally closed position, when the gun is not being operated, i.e., when the handle 100 is not being depressed. The nose portion 46 of the poppet assembly is kept in a seated position against the valve seat 34 of the spray nozzle by the action of the spring 114, loaded in the spring retaining chamber 88, imposing a seating force on the poppet assembly via the poppet connecting element 106.

Figure 5:
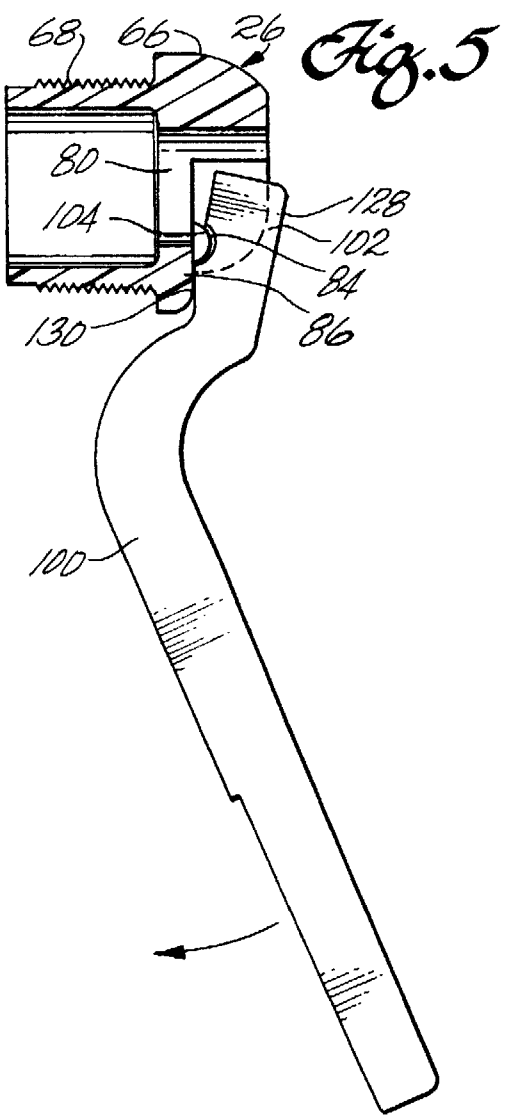
FIG. 5 is a cross-sectional side elevational view of a spring retainer body and handle assembly of the spray gun of FIG. 1 in a medium or high flow position.
Figure 4:
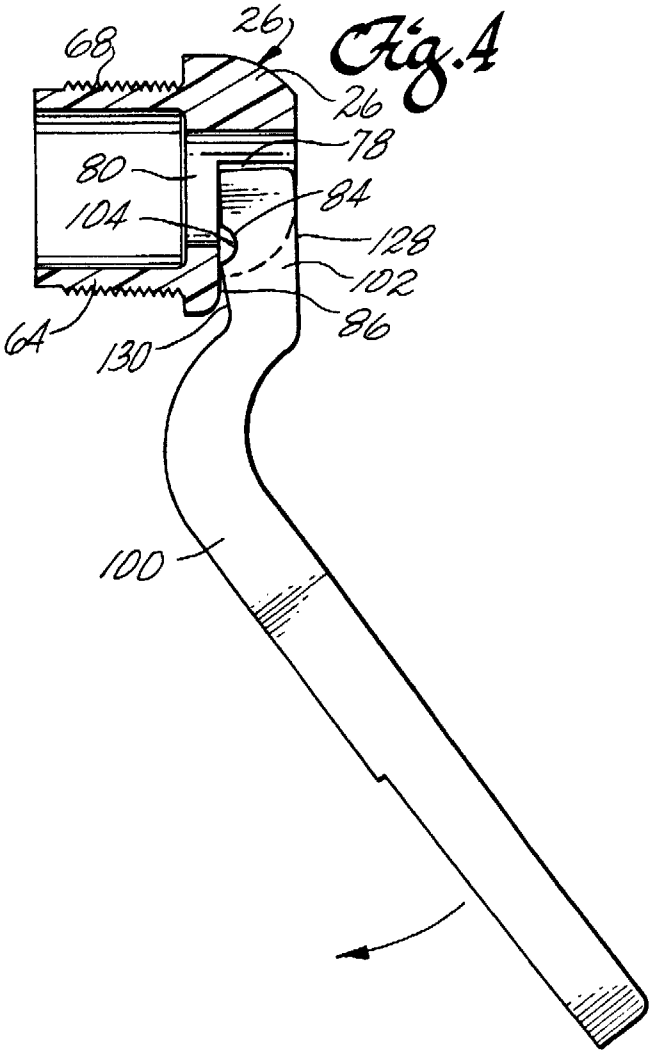
FIG. 4 is a cross-sectional side elevational view of a spring retainer body and handle assembly of the spray gun of FIG. 1 in a no or low flow position.

The spray gun is operated to dispense water by depressing the handle 100, as illustrated in FIGS. 4 and 5. A key feature of the spray gun is that the handle 100 and spring retaining body head 66 are configured to provide a two-stage poppet actuator movement. Referring specifically to FIGS. 1*a*, 2 and 4, when the handle 100 is initially depressed a small amount toward the grip portion 16 of the spray gun body, the actuator end 102 of the handle pivots in the cut-out portion 78 of the spring retaining head 66 according to an initial pivoting action provided by interaction of the grooves 104 and respective pivot extensions 84. This initial pivoting action causes a rear facing surface 128 of the actuator end 102 of the handle, in contact with the poppet actuator flared head 96 (shown in FIG. 1*a*), to axially displace the poppet actuator flared head outwardly away from the spring retaining head 66. The complementary grooves 104 and pivot extensions 84 are designed to provide an initial pivoting action that produces a relatively small amount of poppet actuator displacement, and therefore poppet assembly displacement within the inner chamber, for a given depression of the handle. Constructed in this manner, an operator of the spray gun is able to have fine control of water dispensement from the spray gun at low water flow rates. It is desired that the initial pivoting action of the handle produce a handle displacement to poppet assembly displacement ratio of greater than about 2:1.

Figure 6:
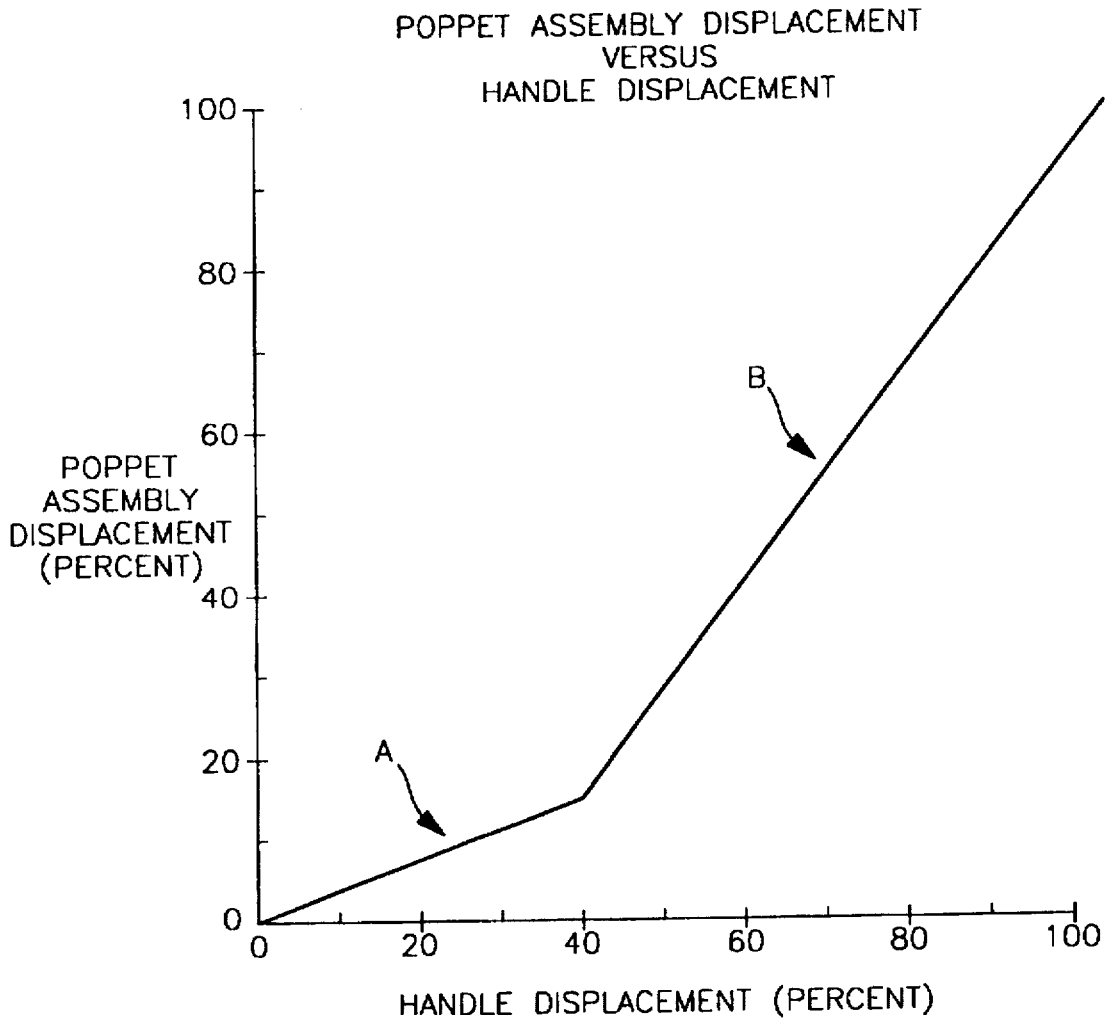
FIG. 6 is a graph illustrating the relationship between poppet assembly displacement and handle displacement for first-stage and second-stage poppet assembly movement of the spray gun.

In an example embodiment, the initial pivoting action of the handle 100 within the spring retaining body head 66 corresponds to a handle displacement in the range of from about 1 to 40 percent of the maximum handle displacement. Displacing the handle within this range produces a first-stage movement of the poppet assembly within the inner chamber in the range of from 1 to 15 percent of the total poppet assembly displacement. This first-stage poppet assembly displacement generally corresponds to water dispensement by the gun in the range of from about 1 to 15 percent of the maximum water dispensement. Referring to FIG. 6, the first-stage axial displacement of the poppet assembly within the chamber relative to handle displacement is illustrated by line A. Line A illustrates that the ratio of handle displacement to poppet assembly displacement is about 2.6:1, i.e., greater than two to one to provide an enhanced degree of poppet assembly movement.

Referring now to FIGS. 1*a* and 5, when the handle 100 is further depressed toward the grip portion of the spray gun, so that the grooves 104 pivot completely about respective pivot extensions 84, a pivot surface 130 of the handle actuator end 102 contacts the adjacent secondary pivot surface 86 of spring retaining body base 80. The contact between adjacent pivot surfaces causes the pivot point for the handle to change and provide a secondary pivot action of the handle. The secondary pivoting action produced by the contacting pivot surfaces 130 and 86 causes a relatively greater degree of poppet actuator displacement within the spring chamber, and therefore poppet assembly displacement within the inner chamber, for a given depression of the handle. It is desired that the secondary pivoting action of the handle produce a handle displacement to poppet assembly displacement ratio of less than about 2:1.

In an example embodiment, the secondary pivoting action of the handle 100 within the spring retaining body head 66 corresponds to a handle displacement in the range of from about 41 to 100 percent of the maximum handle displacement, i.e., a handle displacement of greater than 40 percent. Displacing the handle within this range produces a second-stage movement of the poppet assembly within the inner chamber in the range of from 16 to 100 percent of the total poppet assembly displacement. This second-stage poppet assembly displacement generally corresponds to water dispensement by the gun in the range of from about 16 to 100 percent of the maximum water dispensement. Referring to FIG. 6, the second-stage axial displacement of the poppet assembly within the chamber relative to handle displacement is illustrated by line B. Line B illustrates that the ratio of handle displacement to poppet assembly displacement is about 1.4:1, i.e., less than 2:1.

Constructed in this manner, an operator of the spray gun is able to have both a fine degree of control of water dispensement from the gun at low water flow rates, by depressing the handle a given amount, and be able dispense water at medium and high water flow rates, by depressing the handle a further amount. The two-stage poppet actuator movement allows the spray gun to be used in both applications calling for a low or controlled rate of water dispensement, e.g., for use in washing, cleaning or rinsing delicate objects, and applications calling for maximum water dispensement.

Figure 7:
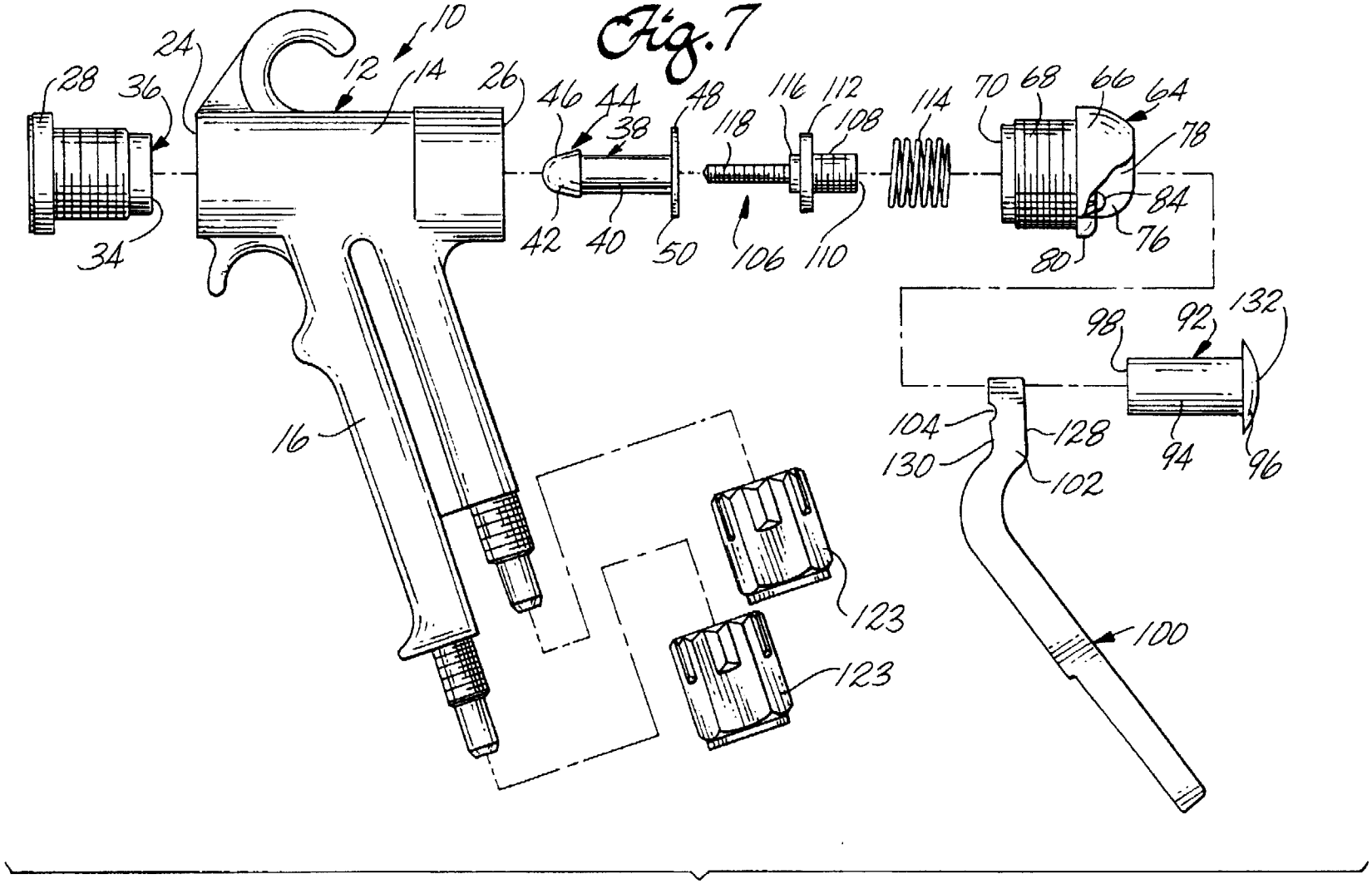
FIG. 7 is an exploded side elevational view of the spray gun of FIG. 1.

Referring to FIG. 7, the spray gun 10 is assembled by loading the poppet assembly 38 into the inner chamber 22 from the rear portion 26 of the barrel. The poppet assembly diaphragm 48 is configured having an outside diameter that is slightly larger than the inside diameter of the adjacent portion of the inner chamber. A loading tool (not shown) is used to place the poppet assembly into position within the inner chamber. The loading tool presses the diaphragm into the inner chamber, causing outer surface of the inner chamber to exert a radially directed loading force onto the circumference of the diaphragm. The loading force causes the diaphragm to take on a relaxed sine-wave profile that is desired so that the diaphragm will not act to resist axial displacement of the poppet assembly. The diaphragm 48 is pressed into the inner chamber until the tongue 50 is completely seated in the groove 72 (as best shown in FIG. 1*a*).

The spring retaining body 64 is assembled by placing the actuator end 102 of the handle into the cut-out portion 78 of the spring retaining head 66, inserting the poppet actuator 92 into the opening 82, placing the spring 114 into the spring retaining chamber 88 and over the outside surface of the poppet actuator body (as best shown in FIG. 1*a*). The first cylindrical section 108 of the poppet connecting element 106 is threadably connected to the threaded end 98 of the poppet actuator so that the first flange 112 of the poppet connecting element 106 contacts the adjacent end 98 of the poppet actuator. A rear facing surface 132 of the poppet actuator flared head 96 can be configured having an attachment for a hand or power rotating tool to facilitate threadable engagement of the poppet actuator and connecting element. For example the rear facing surface 132' can be configured to accommodate attachment with a screwdriver, Allen head wrench, socket wrench, Torx wrench, and the like.

The spring retaining body/poppet actuator/poppet connection element assembly is attached to the rear portion 26 of the barrel 14 by threaded connection between the cylindrical section 68 and the second enlarged diameter section 62 of the inner chamber. As the assembly is installed into the barrel portion of the spray gun, the second cylindrical section 118 of the poppet connecting element 106 threadably engages and is connected within the threaded inside surface of the poppet assembly hollow shaft 40.

Each of the above-described elements that are used to form the spray gun, except for the spring, can be molded or machined from any structurally ridged material such as steel, steel alloy, and the like. It is desired that the spray gun be formed from a material that will not deteriorate or corrode when exposed to deionized, high-purity, or other types of water. Accordingly, polymeric materials such as fluoropolymeric compounds selected from the group consisting of tetrafluoroethylene (TFE), polytetrafluoroethylene (PTFE), fluorinated ethylenepropylene (FEP), perfluoroalkoxy fluorocarbon resin (PFA), polychlorotrifluoroethylene (PCTFE), ethylenechlorotrifluoroethylene copolymer (ECTFE), ethylenetetrafluoroethylene copolymer (ETFE), polyvinylidene fluoride (PVDF), and polyvinyl fluoride (PVF), and the like are preferred. The materials are also preferred because of their hydrophobic properties, which help to prevent water from being retained in the inner chamber, thereby also helping to prevent bacteria formation. It is desired that the spring be formed from a corrosion resistance steel alloy, such as stainless steel.

In an example embodiment of the spray gun constructed for dispensing deionized water, the body 12 and spray nozzle 28 are made from PFA manufactured by DuPont de Nemours, E. I., Co., of Wilmington, Del., under the product name 440 HP. The poppet connecting element 106, spring retaining body 64, poppet actuator 92, handle 100, and nuts 123 are each formed from ETFE manufactured by DuPont de Nemours, E. I., Co., under the product name Tefzel 200. The poppet assembly 38 is formed from PTFE.

Although limited embodiments of the spray gun have been specifically described and illustrated herein, and specific dimensions have been disclosed, many modifications and variations will be apparent to those skilled in the art. Accordingly, it is to be understood that, within the scope of the appended claims, the spray gun according to principles of this invention may be embodied other than as specifically described herein.

What is claimed is:

1. A spray gun comprising:

a body having a barrel portion with an inner chamber extending therethrough, and a grip portion, wherein a water inlet conduit and water outlet conduit are each disposed within the grip portion and extend to the inner chamber;

a valve seat disposed within the inner chamber at a front portion of the barrel;

a one-piece poppet assembly slidably disposed axially within the inner chamber, the poppet assembly having:

a valve element formed from one end of the assembly adapted to form a liquid-tight seal with the valve seat in a no flow position;

a diaphragm formed from an opposite end of the assembly adapted to form a liquid-tight seal with an adjacent portion of the inner chamber, wherein the water inlet conduit enters the inner chamber adjacent the valve element, and wherein the water outlet conduit enters the inner chamber adjacent the diaphragm so that when in a no flow position water entering the inner chamber is circulated between the valve seat and the diaphragm; and a spring retaining body attached at rear portion of the barrel for maintaining the valve element and valve seat in seated engagement when the gun is not being activated, and for unseating the valve element and valve seat by hand activation, wherein the spring retaining body is adapted to accommodate pivotal attachment of a handle therein and includes pivot extensions that project outwardly away from a base portion of the body, wherein the handle includes a groove sized to accommodate placement of the pivot extensions therein, and wherein movement of the groove about the pivot extensions produces an initial pivoting action of the handle causing the poppet assembly to be axially displaced within the inner chamber a small amount relative to handle movement.

2. A spray gun as recited in claim 1 wherein the ratio of handle displacement to poppet assembly movement is greater than 2:1.

3. A spray gun as recited in claim 1 wherein the spring retaining body includes a pivot surface extending downward from a base portion of the body, wherein the handle includes a pivot surface sized to accommodate engagement with the pivot surface of the base portion after the groove has pivoted completely around the pivot extensions, and wherein engagement of the pivot surfaces produces a secondary pivoting action of the handle causing the poppet assembly to be axially displaced within the inner chamber by an amount greater than the initial pivoting action relative to handle movement.

4. A spray gun as recited in claim 3 wherein the ratio of handle displacement to poppet assembly movement is less than 2:1.

5. A spray gun as recited in claim 1 further comprising a poppet actuator disposed through an opening in the spring retaining body, wherein the popper actuator has a cylindrical body and a flared head at one end.

6. A spray gun as recited in claim 5 wherein the spring retaining body includes a head portion at one end and a cylindrical section at an opposite end, wherein the cylindrical section has a spring retaining chamber disposed therein.

7. A spray gun as recited in claim 6 further comprising:

a poppet connecting element connected at one end to the poppet actuator body opposite the flared head, and connected at an opposite end to the poppet assembly adjacent the diaphragm, wherein the poppet connecting element includes a flange interposed between the poppet actuator and the poppet assembly; and a spring disposed within the spring retaining chamber around an outside surface of the poppet actuator body between the poppet connecting element flange and a shoulder of the spring retaining chamber.

8. A spray gun as recited in claim 1 wherein the valve seat is disposed around an inlet end of a spray nozzle attached within the front portion of the barrel.

9. A spray gun comprising:

a body having a barrel portion with an inner chamber extending therethrough, and a grip portion, wherein a water inlet conduit and water outlet conduit are each disposed within the grip portion and each extend to the inner chamber;

a spray nozzle disposed within the inner chamber at a front portion of the barrel, wherein spray nozzle includes a valve seat along an inlet end of an opening extending therethrough;

a poppet assembly slidably disposed axially within the inner chamber, the poppet assembly having a cylindrical body and including:

a valve element at one end of the assembly adapted to form a liquid-tight seal with the valve seat in a no flow position;

a diaphragm at an opposite end of the assembly adapted to form a liquid-tight seal with an adjacent portion of the inner chamber;

a spring retaining body attached to a rear portion of the barrel adapted to accommodate pivotal attachment with a handle, wherein the spring retaining body is adapted to accommodate a spring therein to exert a forward acting force on the poppet assembly when the handle is not depressed to maintain seated engagement between the valve element and the valve seat, and wherein the water inlet conduit enters the inner chamber adjacent the valve element, and wherein the water outlet conduit enters the inner chamber adjacent the diaphragm so that in a no flow position water entering the inner chamber is circulated through the inner chamber between the valve seat and the diaphragm.

10. A spray gun as recited in claim 9 wherein the valve element and diaphragm are integral elements of the poppet assembly body.

11. A spray gun as recited in claim 9 wherein the inner chamber includes an enlarged diameter section at the front portion of the barrel, a constant diameter section adjacent the enlarged diameter section, wherein constant diameter section is smaller in diameter than the enlarged diameter section, and wherein the constant diameter section has a diameter approximately equal to a diameter of the valve element.

12. A spray gun as recited in claim 11 wherein in a no flow position, the valve element is disposed within the inner chamber between the valve seat and the constant diameter section so that a gap exists between the valve element and the constant diameter section to allow water flow therethrough, and wherein in a flow position the valve element is partially disposed within the constant diameter section to restrict water flow therethrough.

13. A spray gun as recited in claim 9 wherein the diaphragm extends radially outward from the poppet assembly body and includes a tongue extending around a peripheral edge of the diaphragm, wherein the tongue is sized to form a water-tight seal within a groove disposed around the inner chamber.

14. A spray gun as recited in claim 13 wherein the tongue has an outside diameter smaller than an inside diameter of the groove to impose a circumferential radially directed loading force on the diaphragm when installed within the inner chamber.

15. A spray gun as recited in claim 9 wherein the spring retaining body and handle each include means for providing an initial and secondary pivoting movement of the handle within the spring retaining body to produce a two-stage movement of the poppet assembly within the inner chamber.

16. A spray gun as recited in claim 15 wherein the means for providing an initial pivoting movement of the handle comprises:

pivot extensions that project outwardly away from a base portion of the body; and a groove in the handle sized to accommodate placement of the pivot extensions therein, and wherein movement of the groove about the pivot extensions produces an initial pivoting action that causes a first-stage movement of the poppet assembly in the range of from 1 to 15 percent of the total poppet assembly displacement within the inner chamber.

17. A spray gun as recited in claim 16 wherein the initial pivoting movement of the handle produces a handle displacement to poppet assembly displacement ratio greater than 2:1.

18. A spray gun as recited in claim 16 wherein the initial pivoting movement of the handle produces in the range of from 1 to 40 percent of the total handle movement.

19. A spray gun as recited in claim 15 wherein the means for providing a secondary pivoting movement of the handle comprises:

a pivot surface extending downward from a base portion of the spring retaining body; and a pivot surface extending along a surface of the handle sized to accommodate engagement with the pivot surface of the base portion after the groove has pivoted completely around the pivot extensions, and wherein engagement of the pivot surfaces produces a secondary pivoting action that causes a second-stage movement of the poppet assembly in the range of from 16 to 100 percent of the total poppet assembly displacement within the inner chamber.

20. A spray gun as recited in claim 19 wherein the secondary pivoting movement of the handle produces a handle displacement to poppet assembly displacement ratio of less than 2:1.

21. A spray gun as recited in claim 20 wherein the secondary pivoting movement of the handle produces in the range of from 41 to 100 percent of the total handle movement.

22. A spray gun as recited in claim 9 further comprising a poppet actuator disposed through an opening in the spring retaining body, wherein the poppet actuator has a cylindrical body and a flared head at one end.

23. A spray gun as recited in claim 22 further comprising:

poppet connecting element connected at one end to the poppet actuator body opposite the flared head, and connected at an opposite end to the poppet assembly adjacent the diaphragm, wherein the poppet connecting element includes a flange interposed between the poppet actuator and the poppet assembly, and wherein the spring is disposed around an outside surface of the poppet actuator body between the flange and a shoulder of the spring retaining chamber.

24. A spray gun comprising:

a body having:

a barrel portion;

an inner chamber extending through the barrel portion from a front portion to a rear portion; and a grip portion including a water inlet conduit and a water outlet conduit extending therethrough to the inner chamber;

a spray nozzle disposed within the inner chamber at the front portion;

a poppet assembly disposed within the inner chamber, wherein the poppet assembly comprising:

a cylindrical shaft-like body;

a valve element at one end of the shaft-like body adjacent the spray nozzle; and a diaphragm at an opposite end of the shaft-like body;

a spring retaining body attached to the rear portion of the barrel, wherein the spring retaining body includes:

a head portion disposed outside of the barrel portion and configured to accommodate placement of a handle therein; and a cylindrical section disposed within the barrel portion and having a spring retaining chamber disposed therein;

a poppet actuator having a cylindrical body and a flared head at one end, wherein the poppet actuator is disposed through an opening in the spring retaining body with the flared head disposed outside of the spring retaining body;

a poppet connecting element having a first cylindrical section at one end attached to an end of the poppet actuator opposite the flared head, having a second cylindrical section at an opposite end attached to the poppet assembly, and having a flange interposed therebetween;

a spring disposed within the spring retaining chamber around an outside surface of the poppet actuator; and a handle having an actuator end pivotally mounted between the head portion of the spring retaining body and the flared head of the poppet actuator.

25. A spray gun as recited in claim 24 wherein the valve element includes a rounded nose portion defining one end, and the spray nozzle includes a valve seat at an inlet end of a passageway extending therethrough, and wherein in a no flow position the nose portion is seated on the valve seat to form a liquid-tight seal.

26. A spray gun as recited in claim 24 wherein the water inlet conduit enters the inner chamber adjacent the valve element.

27. A spray gun as recited in claim 26 wherein the water outlet conduit enters the inner chamber adjacent the diaphragm.

28. A spray gun as recited in claim 24 wherein the diaphragm includes a tongue extending around a peripheral edge, wherein the tongue is disposed within a groove in the inner chamber to form a liquid-tight seal to prevent water from entering the spring retaining chamber.

29. A spray gun as recited in claim 24 wherein the head portion of the spring retaining body includes a pair of pivot extensions projecting outwardly from a base portion of the body, and a pivot surface extending downwardly from the base portion.

30. A spray gun as recited in claim 29 wherein the actuating end of the handle includes a groove adapted to accommodate placement of the pivot extensions therein to provide an initial pivoting movement of between the handle and spring retaining body, and a pivot surface adapted to contact the pivot surface of the base portion of the spring retaining body to provide a secondary pivoting movement, wherein the initial pivoting movement produces a handle displacement to poppet assembly displacement ration of greater than 2:1, and wherein the secondary pivoting movement produces a handle displacement to poppet assembly displacement ration of less than 2:1.

31. A spray gun as recited in claim 30 wherein the initial pivoting movement provides a handle displacement in the range of from 1 to 40 percent of the total handle displacement.

32. A spray gun as recited in claim 31 wherein the secondary pivoting movement provides a handle displacement in the range of from 41 to 100 percent of the total handle displacement.

33. A sprays gun as recited in claim 24 wherein the inner chamber includes an enlarged diameter section at the front portion to accommodate placement of spray nozzle and valve element therein, wherein the inner chamber includes a constant diameter section adjacent the enlarged diameter section having a diameter approximately equal to an outside diameter of the valve element.

34. A spray gun as recited in claim 33 wherein in a flow position the valve element is axially displaced within the constant diameter section and the nose portion is unseated from the valve seat.

* * * * *